US009700989B1

(12) United States Patent
Cooper et al.

(10) Patent No.: US 9,700,989 B1
(45) Date of Patent: Jul. 11, 2017

(54) DRY ICE BLAST CLEANING SYSTEM AND METHOD FOR OPERATING THE SAME

(71) Applicant: Nu-Ice Age, Inc., Clarklake, MI (US)

(72) Inventors: Edward L Cooper, Clarklake, MI (US); Michael Hallenbeck, Brooklyn, MI (US)

( * ) Notice: Subject to any disclaimer, the term of this patent is extended or adjusted under 35 U.S.C. 154(b) by 0 days.

(21) Appl. No.: 14/645,897

(22) Filed: Mar. 12, 2015

(51) Int. Cl.
*B24C 1/00* (2006.01)
*B24C 5/02* (2006.01)
*B24C 7/00* (2006.01)

(52) U.S. Cl.
CPC ..... *B24C 1/003* (2013.01); *B24C 1/00* (2013.01); *B24C 5/02* (2013.01); *B24C 7/0069* (2013.01)

(58) Field of Classification Search
CPC .. B24C 1/00; B24C 1/003; B24C 5/02; B24C 7/0069
USPC ..... 451/99
See application file for complete search history.

(56) References Cited

U.S. PATENT DOCUMENTS 3,914,815 A * 10/1975 Kobayashi ..... B24C 3/327 15/3.5
4,038,786 A * 8/1977 Fong ..... B01F 3/06 451/102
4,389,820 A * 6/1983 Fong ..... B01F 3/0092 451/39
4,617,064 A * 10/1986 Moore ..... B24C 1/003 134/11
4,707,951 A * 11/1987 Gibot ..... B24C 7/0046 451/39
4,942,983 A * 7/1990 Bradbury ..... F25C 5/007 141/360
5,445,553 A * 8/1995 Cryer ..... B24C 1/003 451/39
5,632,150 A * 5/1997 Henzler ..... B24C 1/003 451/39
5,787,716 A * 8/1998 Allen, Jr. ..... A23L 3/361 62/381
6,174,225 B1 * 1/2001 Becker ..... B24C 1/003 451/39
6,524,394 B2 * 2/2003 Okazawa ..... B24C 1/003 134/18
6,558,473 B2 * 5/2003 Okazawa ..... B24C 1/003 134/18
6,890,246 B2 * 5/2005 Yamaharu ..... B24C 7/0092 451/75
7,112,120 B2 * 9/2006 Rivir ..... B24C 1/003 222/170
8,430,722 B2 * 4/2013 Raeder ..... B24C 1/003 241/227
8,696,819 B2 * 4/2014 Boggs ..... B08B 9/032 134/22.1
2002/0068510 A1 * 6/2002 Okazawa ..... B24C 1/003 451/39

(Continued)

FOREIGN PATENT DOCUMENTS

WO WO 9601168 A1 * 1/1996 ..... B24C 1/003
WO WO 2005054760 A2 * 6/2005 ..... B24C 1/003

*Primary Examiner* — Eileen Morgan
(74) *Attorney, Agent, or Firm* — Ronald R. Kilponen

(57) ABSTRACT

A dry ice blast cleaning system is disclosed. The system includes a dry ice feed apparatus, a mixing head, a supply of pressurized gas and a dispensing device. The apparatus has a hopper configured to store a supply of dry ice pieces with an anti-bridging device. A heat by-pass system is provided to heat the mixing head to prevent icing in the mixing head.

7 Claims, 4 Drawing Sheets

(56) References Cited

U.S. PATENT DOCUMENTS

| | | | | |
|---|---|---|---|---|
| 2002/0068511 | A1* | 6/2002 | Okazawa | B24C 1/003 451/39 |
| 2004/0005848 | A1* | 1/2004 | Yamaharu | B24C 7/0092 451/91 |
| 2007/0072520 | A1* | 3/2007 | Becker | B24C 1/003 451/40 |
| 2008/0013399 | A1* | 1/2008 | Jonkheijm | B24C 1/003 366/97 |
| 2008/0176487 | A1* | 7/2008 | Armstrong | B24C 1/003 451/39 |
| 2010/0113576 | A1 | 5/2010 | Raeder | |

* cited by examiner

60

DRY ICE BLAST CLEANING SYSTEM AND METHOD FOR OPERATING THE SAME

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE OR A COMPUTER PROGRAM LISTING COMPACT DISC APPENDIX

Not Applicable

TECHNICAL FIELD

This disclosure relates to the field of dry ice blast cleaning systems. More particularly, the present invention relates to a dry ice blast cleaning system having a dry ice feed apparatus and a method for feeding dry ice pieces within a dry ice blast cleaning system. More particularly, the present invention relates to a dry ice blast cleaning system having a heat by-pass system.

BACKGROUND

The statements in this section merely provide background information related to the present disclosure and may not constitute prior art.

The use of dry ice for blast cleaning is well known in the art. In dry ice blast cleaning systems, pieces of dry ice (solidified Carbon Dioxide, $CO_2$) are drawn into a fluid stream (typically compressed air) and moved through a blast gun. The pieces of dry ice are entrained into the gas stream and propelled out of the gun to impact against the surface to be cleaned. After the dry ice pieces collide with the surface, the dry ice pieces sublimate into gaseous $CO_2$ and become part of the ambient atmosphere. Generally, the only remaining residue from this process is the removed surface debris.

The sizing of the dry ice pieces used in the dry ice blast cleaning system varies with the method used to produce the pieces and the items to be cleaned. One of the most common sizes approximates the size of rice grains. Another form or size of dry ice pieces are rod-shaped dry ice generally called nuggets. Dry ice nuggets generally have a larger size than previously used dry ice pieces but have a much longer shelf life than smaller-sized forms of dry ice pieces available in the market. The problem presented by the use of dry ice nuggets is that their size must be reduced for efficient use in a dry ice blast cleaning system.

One problem with conventional dry ice blast cleaning systems is that the systems are affected by ambient atmospheric conditions. In particular, operation of the conventional dry ice blast cleaning systems can be difficult in environments having high humidity or where the cleaning requires prolonged storage of the dry ice pieces. In such conditions, moisture in the ambient air in and around the system can condense around the dry ice pieces as liquid water or water ice, causing the dry ice pieces to adhere to one another and to clog the system. When operating in adverse ambient atmospheric conditions, it would be advantageous to have a dry ice cleaning blast system having a hopper formed to reduce clogging and increase user safety and to prevent the formation of ice around the dry ice pieces.

In conventional dry ice blast cleaning systems, the hopper includes welded portions having one or more weld lines. The weld lines, specifically those in the lower portion of the hopper and those between the discharge end and the lower portion, can accumulate residue of the dry ice pieces, reducing the flow through of the dry ice pieces and clogging the lower portion. This accumulation of dry ice residue is commonly referred to in the art as "bridging." The dry ice pieces can break down in the hopper, the smaller dry ice pieces or residue are then vibrated together in the hopper which can also cause "bridging." Typically, a user will chisel out the "bridged" dry ice residue. In some cases, a user has been known to keep the dry ice blast cleaning system in an "ON" operating state, risking bodily harm and equipment damage while chiseling out the bridged dry ice pieces or dry ice residue. Additionally, damage to the dry ice blast cleaning system may result from tools or debris falling into the hopper and into the mixing chamber.

There remains a need for a dry ice blast cleaning system which increases the efficiency of the drive ice blast cleaning system by allowing better flow of the dry ice pieces through the system.

BRIEF SUMMARY OF THE INVENTION

A dry ice blast cleaning system including a dry ice feed apparatus is disclosed. A dry ice blast cleaning system optionally having a heat by-pass system is disclosed. The dry ice blast cleaning system includes a dry ice feed apparatus, a mixing head, a supply of pressurized gas, and a dispensing device. In one embodiment, the dry ice blast cleaning system includes a heat by-pass system. The feed apparatus includes a hopper configured to store a supply of solid dry ice pieces (solid $CO_2$), an anti-clogging, anti-bridging device and a discharge extension. The mixing head is in fluid communication with the feed apparatus and in fluid communication with the supply of pressurized gas. A dispensing device is connected to and in fluid communication with the mixing head.

The hopper of the dry ice feeding apparatus is formed of an upper portion and a lower portion. In one embodiment, the hopper is constructed of spun steel and has a smooth interior surface. An anti-bridging device is positioned within the lower portion of the hopper. In one embodiment, the anti-bridging device include a plurality of anti-bridging fingers. The anti-bridging fingers are secured to the interior surface of the hopper. In one embodiment, the anti-bridging fingers extend radially from a center of the anti-bridging device. In one embodiment, the anti-bridging fingers of the anti-bridging device are elongated members having a cylindrical-shape and are situated within the hopper at an angle.

A heat by-pass system optionally extends between the supply of pressurized gas and the mixing head. The heat by-pass system includes a conduit connected between the supply of pressurized gas and the mixing head. In one embodiment, the heat by-pass system has a regulator valve to control the amount of pressurized gas diverted to the mixing head. The pressurized gas from the supply of pressurized gas moves through a conduit, through the fluid inlet in the mixing head and out through an exhaust outlet in the mixing head. In one embodiment, the mixing head has a series of passageways. The passageways in the mixing head are connected between the fluid inlet and the exhaust outlet. In one embodiment, the fluid inlet and the exhaust outlet are in a sidewall of the mixing head. In one embodiment, the pressurized gas diverted from the source of pressurized gas for the heat by-pass system is not regulated. In one embodiment, the amount of pressurized gas moved through the mixing head is determined by the amount of humidity in the ambient air surrounding and in the dry ice blast cleaning system during use of the system. In one embodiment, the more humidity in the air surrounding and in the dry ice blast cleaning system, the more pressurized gas that is moved through the mixing head using the heat by-pass system.

This summary is provided merely to introduce certain concepts and not to identify key or essential features of the claimed subject matter. The substance and advantages of the present invention will become increasingly apparent by reference to the following drawings and the description.

BRIEF DESCRIPTION OF THE SEVERAL VIEWS OF THE DRAWINGS

One or more embodiments will now be described, by way of example, with reference to the accompanying drawings, in which.

DETAILED DESCRIPTION OF THE INVENTION

Figure 1:
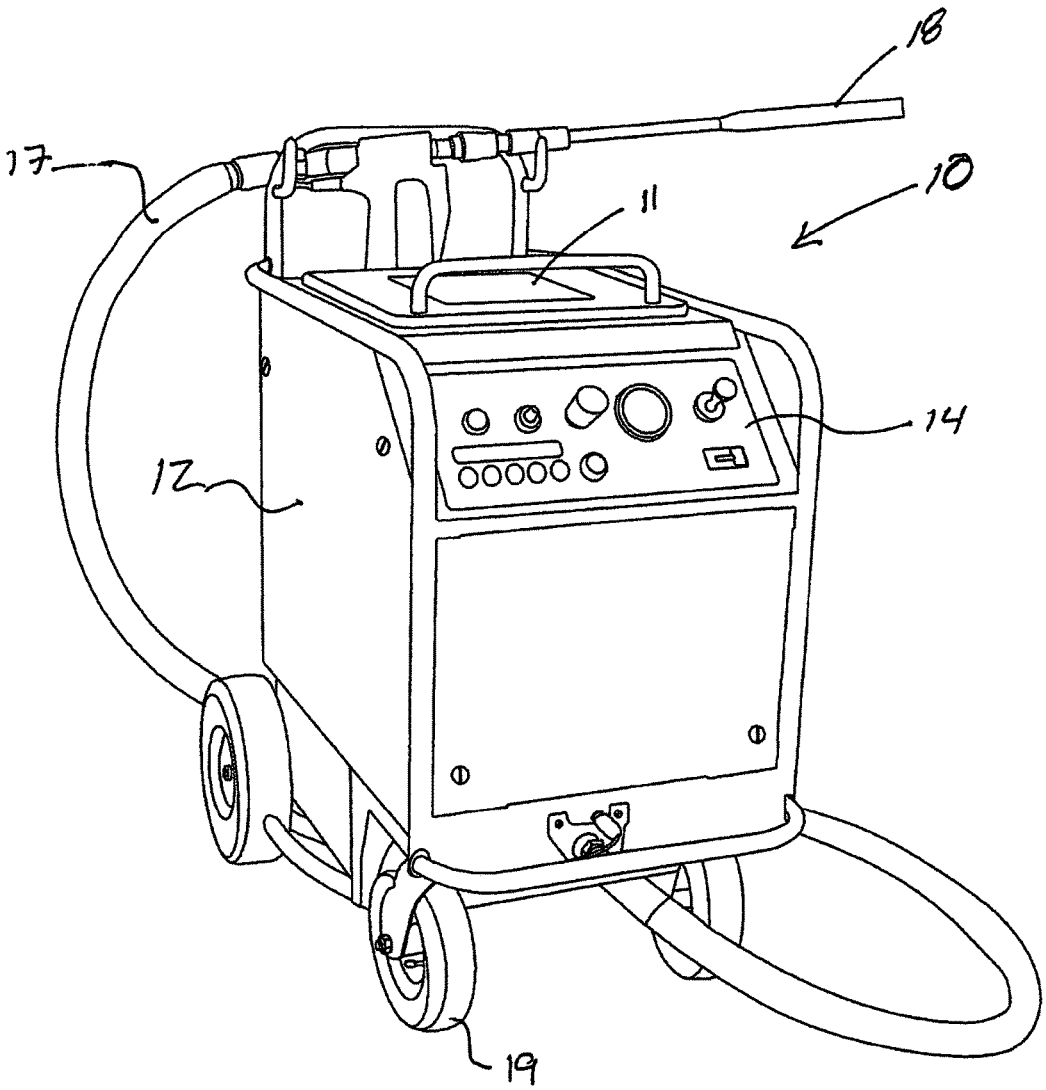
FIG. 1 is a perspective view of a dry ice blast cleaning system 10 showing the hose 17, the dispensing device 18 and the housing 12 for the hopper 20 in accordance with the present disclosure.

Various embodiments of the present invention will be described in detail with reference to the drawings, where like reference numerals represent like parts and assemblies throughout the several views. Reference to various embodiments does not limit the scope of the invention. Additionally, any examples set forth in this specification are not intended to be limiting and merely set forth some of the many possible embodiments for the claimed invention.

Referring now to the drawings, wherein the depictions are for the purpose of illustrating certain one embodiments only and not for the purpose of limiting the same, FIG. 1 shows a dry ice blast cleaning system 10 including a hose 17, a dispensing device 18, and housing 12 having the dry ice feed apparatus 28.

The dry ice blast cleaning system 10 includes a housing 12 configured to house the dry ice apparatus 28 including a hopper 20 or other dry ice storage container, a control system(s) 14, a supply of pressurized gas 16, a hose 17, and a dispensing device 18. Optionally the dry ice blast cleaning system 10 includes a heat by-pass system 60 and 70. In one embodiment, the supply of pressurized gas 16 is an air compressor. A lid 11 is provided for the housing 12 to allow access to the hopper 20. In one embodiment, the lid 11 is configured to sealably contain the dry ice pieces 100 in the hopper. In one embodiment, the lid 11 seals the hopper 20 to reduce exposure to the ambient conditions. In one embodiment, the lid 11 is adapted to cover the upper opening 20A of the hopper 20. Any sealable structure may be used to open and close access to the hopper 20 including lids 11 integrally formed of the hopper 20, lids 11 sealably connected to the hopper 20, and lids 11 hingeably connected to the hopper 20. In one embodiment, the hose 17 is connected at one end through the housing 12 to the mixing head 40 of the dry ice blast cleaning system 10. A dispensing device 18 from which to deliver a dry ice cleaning blast onto a surface is connected to the other end of the hose 17. In one embodiment, the dispensing device 18 is a blast gun. In one embodiment, the dry ice blast cleaning system 10 is mobile and includes a plurality of wheels 16 enabling a user to move the dry ice blast cleaning system 10 about, such as to a location proximate to the surface or item to be cleaned.

Figure 2:
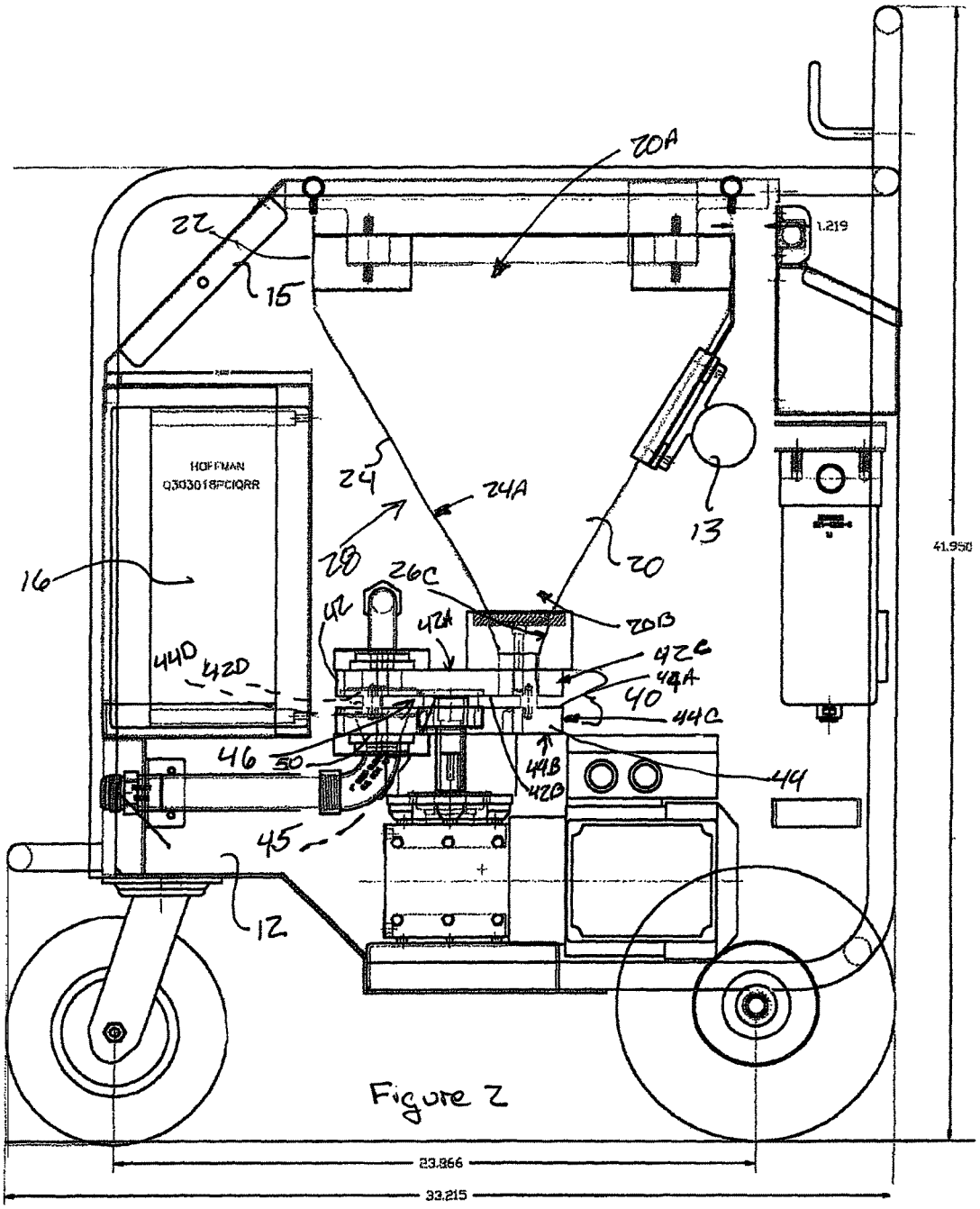
FIG. 2 is a cross-sectional view of the dry ice blast cleaning system 10 showing the dry ice feed apparatus 28, the hopper 20 and the mixing head 40 without the anti-bridging device 30 or the heat by-pass system 60 or 70 in accordance with the present disclosure.

FIG. 2 is a cross-sectional view of one embodiment of the dry ice blast cleaning system 10 showing the feed apparatus 28 including the hopper 20 positioned within the housing 12 of the dry ice blast cleaning system 10 and connected to the mixing head 40. In one embodiment, the hopper 20 includes a vibrator 13 connected to the lower portion 20B of the hopper 20. One purpose of vibrator 13 is to reduce bridging of the dry ice pieces 100 in the lower portion 20B of the hopper 20 as the diameter of the hopper 20 decreases to maintain reliable downward movement of the dry ice pieces 100 within the hopper 20. In one embodiment, the hopper 20 is connected to the housing 12 via damping brackets 15 along a perimeter of an upper portion 22 of the hopper 20, reducing communication of vibrations from the hopper 20 to the housing 12. The hopper 20 is accessed by a user by opening the lid 11 of the dry ice blast cleaning system 10.

The hopper 20 is configured to store a supply of dry ice pieces 100. The hopper 20 includes an upper opening 20A for loading the dry ice pieces 100 and a lower opening 20B for discharge of the dry ice pieces 100. The hopper 20 includes an upper portion 22 and a lower portion 24 spaced between the upper opening 20A and the lower opening 20B. In one embodiment, a diameter of the upper opening 20A is approximately equal to the vertical height of the hopper 20. In one embodiment, the lower opening 20B is defined by a diameter of approximately 16% (16 percent) of the diameter of the upper opening 20A. In one embodiment, the hopper 20 is formed of stainless steel. As one skilled in the art will readily appreciate, the hopper 20 can be adapted for size and volume. In one embodiment, the hopper 20 has an enclosed volume configured to contain approximately 25 kg (55 lbs) of dry ice pieces 100. In one embodiment, the upper portion 22 has a substantially cylindrical shape. In one embodiment, the lower portion 24 slopes downwardly at an angle $\alpha$ of approximately 110-degrees with respect to the upper portion 22. In one embodiment, the lower portion 24 is frusto-conical shaped. In one embodiment, the upper portion 22 and lower portion 24 are integrally formed of the same material. However, as one skilled in the art will recognize, the upper and lower portions 22 and 24 may be separate pieces secured together or formed of different materials.

A discharge extension 26 is connected to the lower portion 24 of the hopper 20 on a side opposite the upper portion 22. The discharge extension 26 has opposed first and second ends 26A and 26B. In one embodiment, the discharge extension 26 has a cylindrical-shape. In one embodiment, the discharge extension 26 is, at least in part, frusto-conical shaped. The discharge extension 26 is configured for discharge of the dry ice pieces 100 from the hopper 20. In one embodiment, the length of the discharge extension 26 between the ends 26A and 26B and the diameter of the discharge extension 26 is determined based upon the intended use for the dry ice blast cleaning system 10. In one embodiment, the length and diameter of the discharge extension 26 is selected based on the size of the dry ice pieces 100 intended for use in the dry ice blast feed system 10. In one embodiment, the discharge extension 26 is integrally formed with the lower portion 24 of the hopper 20. In one embodiment, the discharge extension 26 is connected to the lower portion 24 via welding or other means well known in the art. In one embodiment, a backup washer 36 is provided on an outside surface of the discharge extension 26 to seal the dry ice feed apparatus 28.

In one embodiment, the lower portion 24 of the hopper 20 is formed of spun stainless steel using a metalworking process that includes a spin forming metalworking process. The spin forming metalworking process forms a metal piece into an axially symmetric part having a creaseless and smooth interior. In one embodiment, the interior surface 24A of the lower portion 24 of the hopper 20 is creaseless and smooth. In one embodiment, the hopper 20 is formed into an axially symmetric container from a single piece of metal. In one embodiment, the discharge extension 26 is formed using the same process as used to form the lower portion 24 of the hopper 20. In one embodiment, the interior surface 26C of the discharge extension 26 of the hopper 20 is creaseless and smooth. In the present disclosure, it is contemplated that by eliminating the weld lines between the discharge extension 26 and the lower portion 24, bridging of dry ice pieces 100 in the hopper 20 is reduced. In the present disclosure, it is contemplated that eliminating weld lines and other metal joinery lines in the interior of the hopper 20 where the lower portion 24 narrows to the discharge extension 26 further reduces bridging and clogging due to accumulation of dry ice residue. In one embodiment, the hopper 20, including the upper portion 22 and the lower portion 24 is formed of a single piece of spun stainless steel having no internal corners. In one embodiment, the hopper 20, including the upper portion 22 and the lower portion 24 and the discharge extension 26 are formed of a single piece of spun stainless steel having no internal corners.

Figures 3, 4:
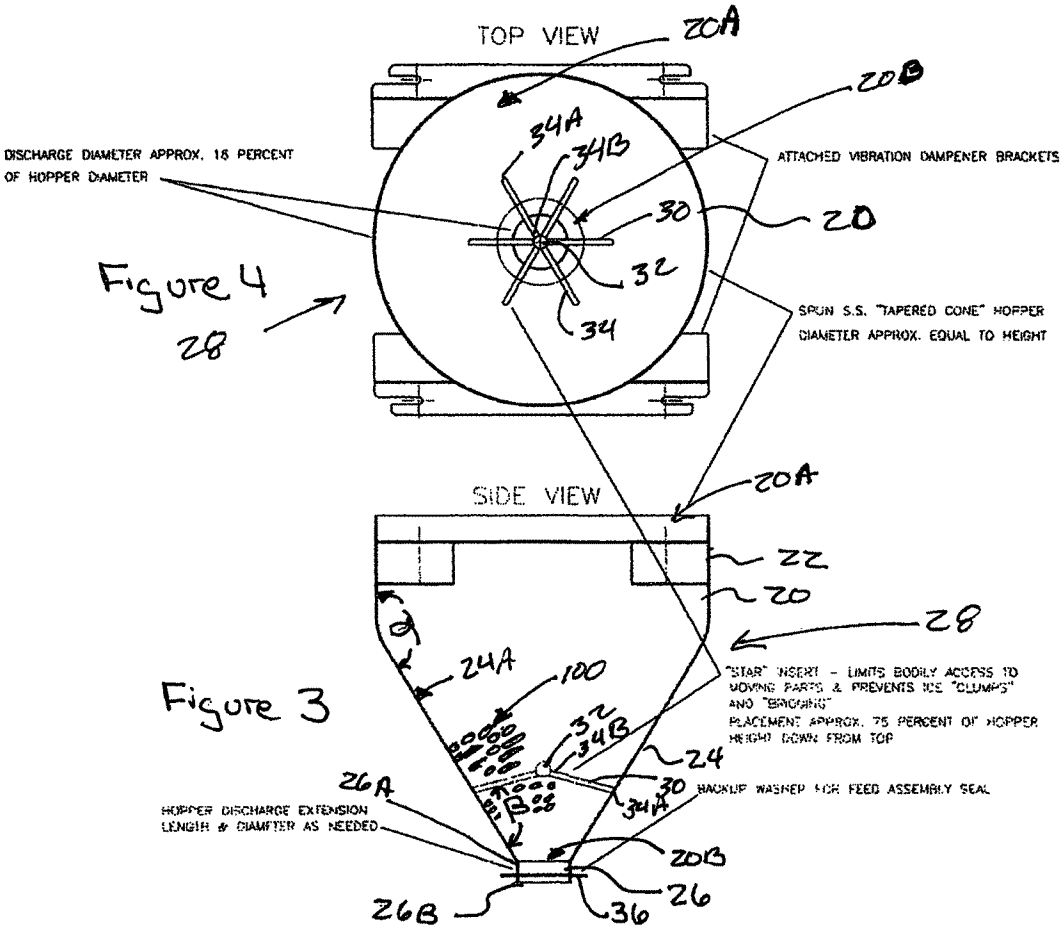
FIG. 3 is a cross-sectional side view of the hopper 20 illustrating the anti-bridging device 30 formed of a plurality of anti-bridging fingers 34, in accordance with the present disclosure.
FIG. 4 is a top view of the hopper 20 showing the anti-bridging device 30 in accordance with the present disclosure.
Figure 5:
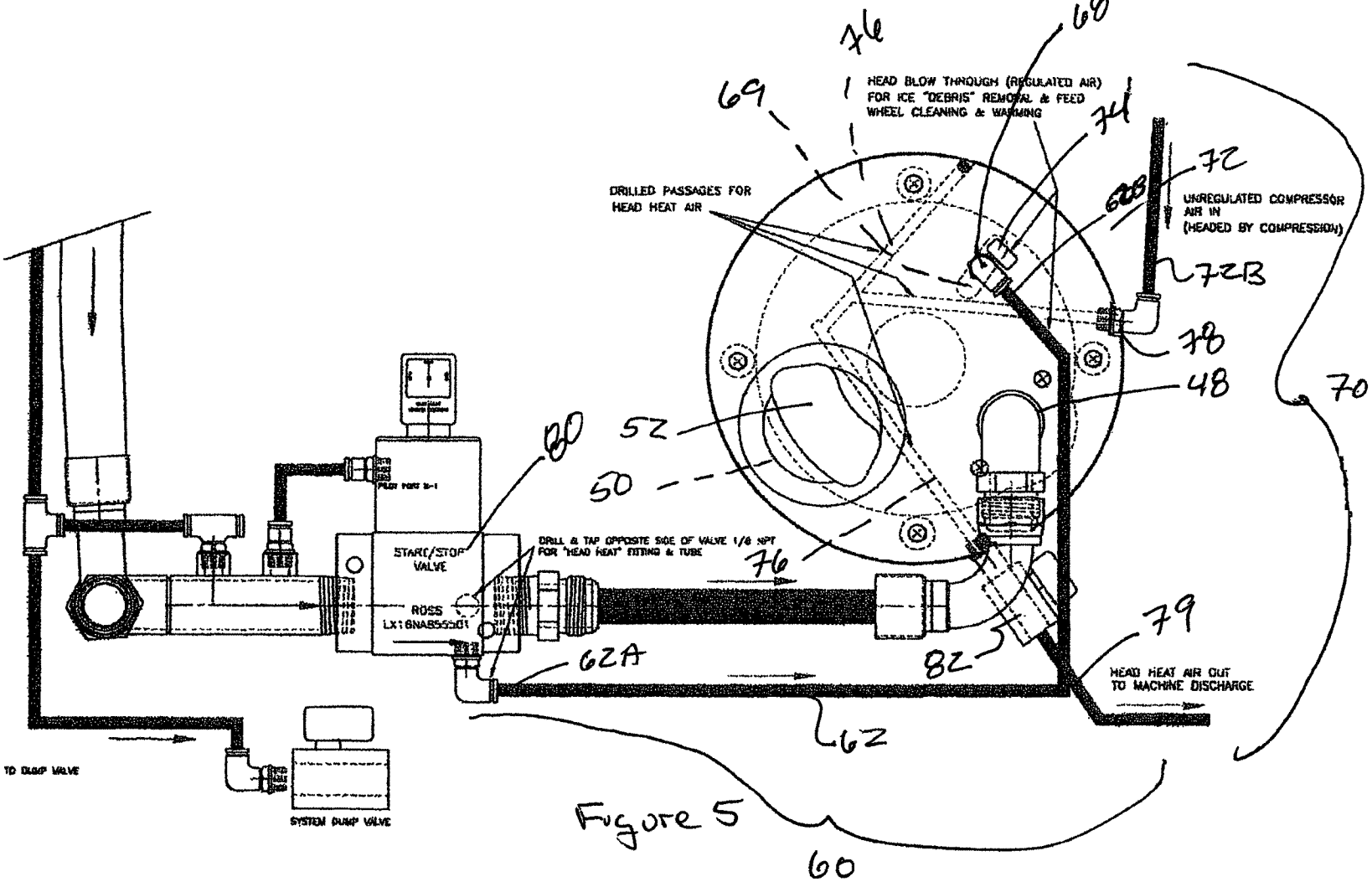
FIG. 5 is a schematic representation of an embodiment of a first heat by-pass system 60 and a second heat by-pass system 70.

An anti-bridging device 30 is positioned in the hopper 20 (FIG. 3). The anti-bridging device 30 includes a plurality of anti-bridging fingers 34 mounted in the interior of the hopper 20. The anti-bridging device 30 is mounted in the lower portion 24 of the hopper 20. In one embodiment, the anti-bridging device 30 is spaced downward from the upper opening of the hopper 20 toward the lower opening 20B of the hopper 20 approximately 75 percent (75%) of a height of the hopper 20 between the upper opening 20A and the lower opening 20B of the hopper 20. The anti-bridging fingers 34 have a first end 34A and a second end 34B. The first ends 34A of the anti-bridging fingers 34 are connected to the interior surface 24A of the lower portion 24 of the hopper 20. In one embodiment, the anti-bridging device 30 is located centrally within the lower portion 24 of the hopper 20. The span or size of the anti-bridging device 30 is greater than the diameter of the lower opening 20B of the hopper 20. In one embodiment, the first ends 34A of the anti-bridging fingers 34 may be welded or otherwise secured to the interior surface 20C of the hopper 20. The anti-bridging fingers 34 extend radially inward from the first ends 34A adjacent the interior surface 24A of the lower portion 24 of the hopper 20 toward the second ends 34B of the anti-bridging fingers 34, toward a center of the lower portion 24 of the hopper 20 and toward a center point of the anti-bridging device 30. In one embodiment, a center hub 32 is provided at the connection point of the second ends 34B of the anti-bridging fingers 34. In one embodiment, the center hub 32 of the anti-bridging device 30 has a radiused, upper surface. In one embodiment, the anti-bridging fingers 34 are symmetrically spaced apart from one another. It is understood that any distribution of anti-bridging fingers 34 may be used to form the anti-bridging device 30. It is contemplated that any number of anti-bridging fingers 34 may be utilized in the anti-bridging device 30 and therefore the disclosure herein is not intended to be limited to the number shown. In one embodiment, the anti-bridging device 30 has a spoke-like shape with the anti-bridging fingers 34 extending outward from a center point of the hopper 20 to the interior surface 24A of the lower portion 24 of the hopper 20. In one embodiment, the anti-bridging fingers 34 are radially and evenly spaced about a center point of the lower portion 24 of the hopper 20. In one embodiment, the anti-bridging fingers 34 are radially and evenly spaced about a center point of the lower portion 24 of the discharge extension 26. In one embodiment, the center point of the anti-bridging device 30 is spaced above the center of the lower opening 20B of the hopper 20. In one embodiment, the anti-bridging fingers 34 are elongated members having a cylindrical-shape. In one embodiment, the anti-bridging fingers 34 are positioned within the hopper 20 at an angle (FIG. 4). In one embodiment, the anti-bridging fingers 34 are angled upward from the interior surface 24A of the lower portion 24 of the hopper 20 to a center region within the hopper 20. In one embodiment, the anti-bridging fingers 34 are arranged in the upward angle to increase tensile strength of the anti-bridging device 30. In one embodiment, the anti-bridging fingers 34 angle upward from the interior surface 24A of the lower portion 24 of the hopper 20 toward the upper opening 20A of the hopper 20 at an angle θ of greater than approximately 45° (45 degrees) (FIG. 3). In one embodiment, the angle θ is between approximately 45° and 60° (45 and 60 degrees). The anti-bridging device 30 may be formed of any durable material well known in the art. In one (1) embodiment, the anti-bridging device 30 is constructed of steel or stainless steel.

The dry ice blast cleaning system 10 includes a mixing head 40 connected to and in fluid communication with the discharge extension 26 at the lower opening 20B of the dry ice feed apparatus 28. The mixing head 40 includes an upper head 42, a lower head 44, a feed wheel 45, a pressurized gas inlet 48 for the pressurized gas, a dry ice opening 52 for input of the dry ice pieces 100 and a discharge opening 50 connected to the dispensing device 18. A fluid inlet 68 and 78 and an exhaust outlet 69 and 79 for the heat by-pass system 60 or 70 are optionally provided in the mixing head 40. It is understood by one skilled in the art that mixing heads for dry ice blast cleaning systems can have a variety of shapes and sizes. The upper head 42 has a top surface 42A and a bottom surface 42B with a sidewall 42C extending therebetween. The discharge extension 26 is connected and in fluid communication with the top surface 42A of the upper head 42 through the dry ice opening 52. In one embodiment a back-up washer 36 is provided around the discharge extension 26 adjacent the top surface 42A of the upper head 42 to provide a seal at the connection of the discharge extension 26 and the mixing head 40. In one embodiment, the interior surfaces between the mixing head 40 and the hopper 20 are smooth. The lower head 44 has a top surface 44A and a bottom surface 44B with a sidewall 44C extending therebetween. The bottom surface 42B of the upper head 42 and the top surface 44A of the lower head 44 are provided with a cut-out 42D and 44D. In one embodiment, essentially the entire center section of the bottom surface 42B of the upper head 42 and the top surface 44A of the lower head 44 is cut out or indented. The bottom surface 42B of the upper head 42 is mounted adjacent the top surface 44A of the lower head 44 such the cut-outs 42D and 44D are adjacent and form an inner chamber 46 of the mixing head 40. In one embodiment, the size and shape of the upper head 42 is essentially identical to the size and shape of the lower head 44. In one embodiment, the upper and lower heads 42 and 44 have a cylindrical shape. In one embodiment, the upper and lower heads 42 and 44 have a circular or plate-like shape. In one embodiment, the top surface 42A of the upper head 42 has a fluid inlet 68 and 78 for connection of the heat by-pass system 60 and 70. In one embodiment, the sidewall 42C of the upper head 42 has a fluid inlet 68 and 78 for connection of the heat by-pass system 60 and 70. A feed wheel 45 is mounted in the inner chamber 46 of the mixing head 40. In one embodiment, the feed wheel 45 is a rotor. In one embodiment, the mixing head 40 has a circular shape and the feed wheel 45 is centrally mounted within the mixing head 40.

The pressurized gas supply system includes a supply of pressurized gas 16, a control valve 80, and a gas conduit extending between the control valve 80 and the pressurized gas inlet 48 on the upper head 42 of the mixing head 40. The bottom surface 44B of the lower head 44 of the mixing head 40 is provided with the discharge opening 50 connected to and in fluid communication with the dispensing device 18. In one embodiment, the dispensing device 18 is connected to the discharge opening 50 by a hose 17. In one embodiment, the dispensing device 18 is a blast gun having a trigger.

Optionally, the dry ice blast cleaning system 10 includes a heat by-pass system 60 or 70. The heat by-pass system 60 or 70 extends between the supply of pressurized gas 16 and the mixing head 40. The heat by-pass system 60 or 70 includes a conduit 62 and 72 extending between the supply of pressurized gas 16 and the mixing head 40. The conduit 62 and 72 has a first end 62A and a second end 62B and 72B. The first end 62A of the conduit 62 and 72 is connected to and in fluid communication with the supply of pressurized gas 16. The second end 62B and 72B is connected to and in fluid communication with the mixing head 40. In one embodiment, the second end 62B of the heat by-pass conduit 62 is connected to a fluid inlet 68 in the upper head 42 of the mixing head 40. In one embodiment, the first end 62A of the conduit 62 is connected to and in fluid communication with a control valve 80 of the pressurized gas system. The control valve 80 allows for starting and stopping the flow of pressurized gas to the mixing head 40 from the supply of pressurized gas 16. In one embodiment, the heat by-pass system 60 include a regulator valve 74. In one embodiment, the second end 62B of the conduit 62 is connected to a fluid inlet 68 in the top surface 42A of the upper head 42 of the mixing head 40. In one embodiment, the fluid inlet 78 is located in the sidewall 42C of the upper head 42 and the second end 72B of the conduit 72 is connected to and in fluid communication with the fluid inlet 78 in the sidewall 42C of the upper head 42. In one embodiment, a regulator valve 74 is connected to and in fluid communication with the conduit 62 to control the amount of pressurized gas diverted to the mixing head 40. In one embodiment, the regulator valve 74 is mounted adjacent the fluid inlet 68 and 78 in the mixing head 40. However, it is understood that the regulator valve 74 could be positioned anywhere along the conduit 62 to control the flow of diverted pressurized gas into the mixing head 40. In one embodiment, an exhaust valve 82 is provided adjacent the exhaust outlet 69 and 79 to control the flow of diverted pressurized gas exiting the mixing head 40. In a second embodiment of the heat by-pass system 70, a series of passageways 76 are provided in the mixing head 40. In one embodiment, the passageways 76 are in the upper head 42. In one embodiment, the passageways 76 are in the lower head 44. In one embodiment, the passageways 76 are in both the upper head 42 and the lower head 44 of the mixing head 40. The passageways 76 have a fluid inlet 78 connected and in fluid communication with the source of pressurized gas 16 and an exhaust outlet 79 for exhausting the diverted, pressurized gas out the mixing head 40. In one embodiment, where passageways 76 are provided in the upper head 42, the fluid inlet 78 and the exhaust outlet 79 are in the sidewall 42C of the upper head 42. In one embodiment, where passageways 76 are provided in the lower head 44, the fluid inlet 78 and the exhaust outlet 79 are in the sidewall 44C of the lower head 44. In one embodiment, where passageways 76 are provided in both the upper and lower heads 42 and 44, the fluid inlet 78 and exhaust outlet 79 are in the sidewalls 42C and 44C of both the upper and lower heads 42 and 44. In one embodiment, the fluid inlet 68 and exhaust outlet 69 of the heat by-pass system 60 are in the top surface 42A of the upper head 42. In one embodiment, the fluid inlet 68 and exhaust outlet 69 for the heat by-pass system 60 are in the bottom surface 44B of the lower head 44. In one embodiment, the pressurized gas diverted from the source of pressurized gas in the heat by-pass system 60 and 70 is not regulated. In one embodiment, the mixing head 40 has the first heat by-pass system 60 or the second heat by-pass system 70. In one embodiment, the mixing head 40 has both the first heat by-pass system 60 and the second heat by-pass system 70.

In operation, dry ice pieces 100 are input into the upper opening 20A of the hopper 20. The dry ice pieces 100 are gravitationally fed down the hopper 20 toward the discharge extension 26. The smooth spun interior surface 20C of the hopper 20 assists in allowing the dry ice pieces 100 to move quickly and effortlessly from the upper portion 22 of the hopper 20 to the discharge extension 26. The anti-bridging device 30 assists the downward movement of the dry ice pieces 100 within the hopper 20. As the dry ice pieces 100 move toward and past the anti-bridging device 30 in the lower portion 24 of the hopper, the anti-bridging device 30 acts to separate the dry ice pieces 100 thereby reducing clogging adjacent to the lower opening 20B and within the discharge extension 26. In one embodiment, where the dry ice pieces 100 are larger in size such as dry ice pellets, the anti-bridging device 30 acts to break the larger dry ice pellets into small dry ice pieces 100. In one embodiment, where the anti-bridging fingers 34 are arranged in an upward angle, the increased surface area of the anti-bridging device 30 acts to communicate the vibrations of the hopper 20 to the dry ice pieces 100. In one embodiment, the upward angle of the anti-bridging fingers 34 acts to physically sort dry ice pieces 100 as the dry ice pieces 100 move past the anti-bridging device 30. The angled anti-bridging fingers 34 physically break apart the combined dry ice pieces 100 as the dry ice pieces 100 move past the anti-bridging device 30 pressed downward by the supply of dry ice pieces 100. In one embodiment, the anti-bridging device 30 in the hopper 20 communicates the vibrations from the vibrator 13 connected to the hopper 20 to a center region of the hopper 20 resulting in a more even distribution of vibrations among the dry ice pieces 100 within the lower portion 24 of the hopper 20 and thereby further reducing bridging.

The dry ice pieces 100 move from the hopper 20 through the discharge extension 26, through the dry ice opening 52 in the upper head 42 of the mixing head 40 and into the inner chamber 46 of the mixing head 40. In the inner chamber 46 of the mixing head 40, the feed wheel 45 rotates adjacent the dry ice opening 52 and contacts the dry ice pieces 100 as the dry ice pieces 100 enter into the mixing head 40. The feed wheel 45 in the mixing head 40 rotates in the mixing head 40 moving the dry ice pieces 100 into the flow of pressurized gas from the supply of pressurized gas 16 entering the pressurized gas inlet 48 in the mixing head 40. The dry ice pieces 100 are entrained in the pressurized gas flowing from the supply of pressurized gas 16 into the mixing head 40 and float around in the inner chamber 46 of the mixing head 40. When the dispensing device 18 is activated, the dry ice pieces 100 entrained in the flow of pressurized gas move and exit through the discharge opening 50 in the lower head 44 of the mixing head 40, into the hose 17 and through the dispensing device 18. In one embodiment, the dispensing device 18 is activated by a trigger.

Optionally when the dispensing device 18 is activated, the heat by-pass system 60 and 70 is also activated. In one embodiment, the heat by-pass system 60 and 70 is activated when the dispensing device 18 is activated. In one embodiment, the heat by-pass system 60 and 70 is activated when the trigger of the blast gun is pulled. In one embodiment, the heat by-pass system 60 and 70 operates continuously regardless of whether or not the dispensing device 18 is activated. When the heat by-pass system 60 and 70 is activated, pressurized gas from the supply of pressurized gas 16 is diverted from the supply of pressurized gas 16 to the mixing head 40. The diverted pressurized gas from the supply of pressurized gas 16 moves through the conduit 62, through the mixing head 40 and out through an exhaust outlet 69 in the lower head 44 of the mixing head 40. The heat by-pass system 60 and 70 moves heated or warmed pressurized gas diverted from the supply of pressurized gas 16 into and through the mixing head 40 to warm the mixing head 40 to assist in the removal of dry ice residue and to prevent water ice build-up in the mixing head 40. The temperature of the pressurized gas is greater than the temperature of the dry ice pieces 100. The temperature of the diverted pressurized gas of the heat by-pass system 60 and 70 is greater than a temperature of the mixing head 40 having the dry ice pieces 100. In one embodiment, the diverted pressurized gas of the heat by-pass system 60 and 70 has a temperature of approximately the ambient air surrounding the dry ice blast cleaning system 10. In one embodiment, the amount of diverted pressurized gas that is moved through the mixing head 40 by the heat by-pass system 60 and 70 is determined by the amount of humidity in the ambient air around and in the dry ice blast cleaning system 10 during use of the system 10. In one embodiment, the more humidity in the air in and around the dry ice blast cleaning system 10, the more pressurized gas that is diverted and moved through the mixing head 40 using the heat by-pass system 60 and 70. The higher temperature of the diverted pressurized gas heats the mixing head 40. The heating of the mixing head 40 helps to prevent the feed wheel 45 from freezing. The heating of the mixing head 40 helps to prevent icing of the mixing head 40 which allows for unimpeded movement of the feed wheel 45. In one embodiment, during use of the dry ice blast cleaning system 10, moisture from the surrounding ambient air forms as ice adjacent the discharge opening 50 of the mixing head 40, the heating of the mixing head 40 by the heat by-pass system 60 and 70 reduces or prevents moisture in the ambient air from turning to ice on the discharge opening 50 in the lower head 44 of the mixing head 40. The flow of the warm diverted pressurized gas though the mixing head 40 results in less ice build-up in the inner chamber 46 of the mixing head 40. Ice build-up in the inner chamber 46 tends to impede the flow of the dry ice pieces 100 though the mixing head 40 and out through the discharge opening 50 and the dispensing device 18. In one embodiment, the contact of the feed wheel 45 with the dry ice pieces 100 causes the pieces 100 to break down and create dry ice residue in the mixing head 40. When the ambient air surrounding the mixing head 40 is warm, the moisture in the air condenses in the mixing head 40 and forms ice particles which act to hold the dry ice pieces 100 or dry ice residue together clogging the flow of the dry ice pieces 100 out of the discharge opening 50 of the mixing head 40. The heat by-pass system 60 and 70 heats the mixing head 40 which reduces the formation of the ice particles and helps prevent the dry ice pieces 100 from sticking together and clogging the discharge opening 50.

In the foregoing description, various features of the present invention are grouped together in one or more embodiments for the purpose of streamlining the disclosure. This method of disclosure is not to be interpreted as reflecting an intention that the claimed invention requires more features than are expressly recited in each claim. Rather, as the following claims reflect, inventive aspects lie in less than all features of a single foregoing disclosed embodiment. Thus, the following claims are hereby incorporated by reference herein in their entirety, with each claim standing on its own as a separate embodiment of the present invention.

It is intended that the foregoing description be only illustrative of the present invention and that the present invention be limited only by the hereinafter appended claims.

We claim:

1. A dry ice feeding apparatus, comprising:

a hopper configured to store a supply of dry ice pieces, the hopper having an upper portion connected to a frusto-conical lower portion, the lower portion having a lower opening adjacent an end of the lower portion opposite the upper portion;

the lower opening in fluid communication with a mixing head, the mixing head having an upper head and a lower head;

the upper head having a top surface, a bottom surface and a sidewall, the lower head having a top surface, a bottom surface and a sidewall;

the bottom surface of the upper head affixed to the top surface of the lower head, an inner chamber located between the upper head and the lower head;

a discharge opening in the bottom surface of the bottom head, the discharge opening attached to a hose;

an anti-bridging device mounted in the lower portion of the hopper and positioned over the lower opening of the lower portion of the hopper, the anti-bridging device having a plurality of anti-bridging fingers, the fingers having a first end and a second end, the first end fixed to and extending from an inner surface of the lower portion of the hopper, the second end attached to a fixed center hub;

a vibrator attached to the hopper and;

a dispensing device connected to the hose.

2. The fingers and center hub of claim 1 wherein:

the center hub is nearer the upper portion of the hopper than the first end of the fingers.

3. The fingers and center hub of claim 1 wherein:

the center hub is nearer the lower portion of the hopper than the first end of the fingers.

4. A dry ice blast cleaning system, comprising:

a hopper configured to store a supply of dry ice pieces, the hopper having an upper portion connected to a frusto-conical lower portion, the lower portion having a lower opening adjacent an end of the lower portion opposite the upper portion;

the lower opening in fluid communication with a mixing head, the mixing head having an upper head and a lower head;

the upper head having a top surface, a bottom surface and a sidewall, the lower head having a top surface, a bottom surface and a sidewall;

the bottom surface of the upper head affixed to the top surface of the lower head, an inner chamber located between the upper head and the lower head;

a discharge opening in the bottom surface of the bottom head, the discharge opening attached to a hose;

an anti-bridging device mounted in the lower portion of the hopper and positioned over the lower opening of the lower portion of the hopper, the anti-bridging device having a plurality of anti-bridging fingers, the fingers having a first end and a second end, the first end fixed to and extending from an inner surface of the lower portion of the hopper, the second end attached to a fixed center hub;

a supply of pressurized gas connected to a passage way in fluid communication with a control valve and with the bottom surface of the lower head of the mixing head;

a first heat bypass connected to the supply of pressurized gas, the first heat bypass having a conduit, the conduit connected to a control valve, the control valve connected to the conduit and the conduit in fluid communication with the bottom surface of the lower head;

a dispensing device attached to the hose and;

a vibrator attached to the hopper.

5. The fingers and center hub of claim 4 wherein:

the center hub is nearer the upper portion of the hopper than the first end of the fingers.

6. The fingers and center hub of claim 4 wherein:

the center hub is nearer the lower portion of the hopper than the first end of the fingers.

7. A dry ice blast cleaning system, comprising:

a hopper configured to store a supply of dry ice pieces, the hopper having an upper portion connected to a frusto-conical lower portion, the lower portion having a lower opening adjacent an end of the lower portion opposite the upper portion;

a mixing head in fluid communication with the lower opening of the hopper, the mixing head having an upper head and a lower head;

the upper head having a top surface, a bottom surface and a sidewall, the lower head having a top surface, a bottom surface and a sidewall;

the bottom surface of the upper head affixed to the top surface of the lower head, an inner chamber located between the upper head and the lower head;

a discharge opening in the bottom surface of the bottom head, the discharge opening attached to a hose;

a supply of pressurized gas connected to a passage way in fluid communication with a control valve and with the bottom surface of the lower head of the mixing head;

a first heat bypass connected to the supply of pressurized gas, the first heat bypass having a conduit, the conduit connected to a control valve, the control valve connected to the conduit and the conduit in fluid communication with the bottom surface of the lower head; and a dispensing device attached to the hose.

* * * * *